US005953756A

United States Patent [19]

Vrissimdjis

[11] Patent Number: 5,953,756

[45] Date of Patent: Sep. 21, 1999

[54] GLOVE OF RUBBER OR THE LIKE

[76] Inventor: Constantine Solon Vrissimdjis, 3, Parnithos Street, 183 46 Moschato, Greece

[21] Appl. No.: 08/910,881

[22] Filed: Aug. 13, 1997

[30] Foreign Application Priority Data

Aug. 13, 1996 [GR] Greece ..... 960100289

[51] Int. Cl.[6] ..... A41D 13/08; A41D 19/00

[52] U.S. Cl. ..... 2/168; 2/162; 2/169; 2/16; 264/303

[58] Field of Search ..... 2/168, 162, 158, 2/159, 161.6, 161.1, 167, 169, 16, 125, 59; 264/299, 301, 303, 318

[56] References Cited

U.S. PATENT DOCUMENTS

| | | | |
|---|---|---|---|
| 692,703 | 2/1902 | Pfeiffer, Jr. | 2/168 |
| 924,545 | 6/1909 | Emmert | 2/162 |
| 1,407,658 | 2/1922 | Kelly . | |
| 2,106,348 | 1/1938 | Hall et al. | 3/168 |
| 2,117,417 | 5/1938 | Hall et al. | 2/168 |
| 2,299,855 | 10/1942 | Smith | 2/168 |
| 2,821,718 | 2/1958 | Hall et al. | 2/168 |
| 3,391,406 | 7/1968 | Lucas | 2/161.6 |
| 3,681,784 | 8/1972 | Lindley | 2/162 |
| 4,095,293 | 6/1978 | Heavner et al. | 2/168 |
| 4,399,567 | 8/1983 | Weon Joong | 2/162 |
| 4,464,796 | 8/1984 | Heissenberger et al. | 2/168 |
| 5,442,816 | 8/1995 | Seketa | 2/168 |
| 5,682,612 | 11/1997 | Schwarz | 2/168 |

FOREIGN PATENT DOCUMENTS

| | | | |
|---|---|---|---|
| 214126 | 3/1958 | Australia | 2/168 |
| 1191135 | 10/1959 | France | 2/168 |
| 56-98122 | 8/1981 | Japan . | |

*Primary Examiner*—Amy B. Vanatta
*Attorney, Agent, or Firm*—Griffin, Butler, Whisenhunt & Szipl, LLP

[57] ABSTRACT

Glove of rubber or the like provided with an essentially tubular sleeve portion (15) and a cuff portion (14) which extends conically outwardly in extension of the sleeve portion (15) and can be folded back such that the free end of the conically outwardly extending cuff portion (14) has a radial distance from the outer circumference of the sleeve portion (15), wherein at least one inwardly directed undulation (12) of the glove material is provided between the sleeve portion (15) and the cuff portion (14), when the cuff portion (14) extends in extension of the sleeve portion (15), and a thickened wall portion (9) is provided adjacent the undulation (12), wherein the cuff portion (14) is foldable back around the undulation (12).

Further, a mold for producing such a glove is provided.

13 Claims, 11 Drawing Sheets

GLOVE OF RUBBER OR THE LIKE

BACKGROUND OF THE INVENTION

The present invention relates to a glove according to a glove of rubber or the like provided with an essentially tubular sleeve portion and a cuff portion which extends conically outwardly in extension of the sleeve portion and can be folded back such that the free end of the conically outwardly extending cuff portion has a radial distance from the outer circumference of the sleeve portion.

A glove of rubber or the like is known from U.S. Pat. No. 2,117,417, which glove is provided with a spaced pair of annular grooves between a tubular sleeve portion and an outwardly flared cuff portion, whereby said outwardly flared cuff portion may be turned back at said grooves to form an endless outwardly flared trough entirely spaced from the exterior of the remainder of the tubular sleeve portion, the width of the bottom of said trough being substantially the distance between said grooves. As the turned-back cuff portion is kept at a distance at all points from the tubular sleeve portion of the glove, the cuff portion is not stable with regard to the easily deformable portion between the grooves, which portion is subjected to stresses of the material because of widening of the diameter on the position of the outer groove. Furthermore, the cuff portion is rounded outwardly, when the cuff portion extends in extension of the sleeve portion.

U.S. Pat. No. 2,821,718 shows a similar embodiment of two spaced apart grooves between tubular sleeve portion and cuff portion, wherein longitudinal corrugations are provided on the cuff portion and the sleeve portion for maintaining a radial distance between these two portions when the cuff portion is folded back.

It is an object of the invention to provide a glove of a rather thin, flexible material provided with a stable cuff portion in the turned-back position which cuff portion maintains its shape and protective characteristic without collapsing or losing its firm position during movement of the hand wearing the glove.

Further, it is an object of the invention to provide a mould for forming such a glove.

SUMMARY OF THE INVENTION

According to principles of this invention, in a cross-sectional view of the glove, there is at least one inwardly directed undulation of a glove wall between a sleeve portion and a conically outwardly extending cuff portion, when the cuff portion also extends in the same linear direction as the sleeve portion and wherein there is a thickened wall portion adjacent the undulation between the undulation and cuff portion, with the cuff portion being foldable back about the undulation to be positioned adjacent the sleeve portion.

Due to the structure of the glove and the mould between the cylindrical portion and the conically outwardly extending portion, a stable shape of the turned-back cuff position can be maintained.

BRIEF DESCRIPTION OF THE DRAWINGS

The invention is described in more detail by examples of embodiments of the glove and the mould.

DETAILED DESCRIPTION OF PREFERRED EMBODIMENTS

Figure 1:
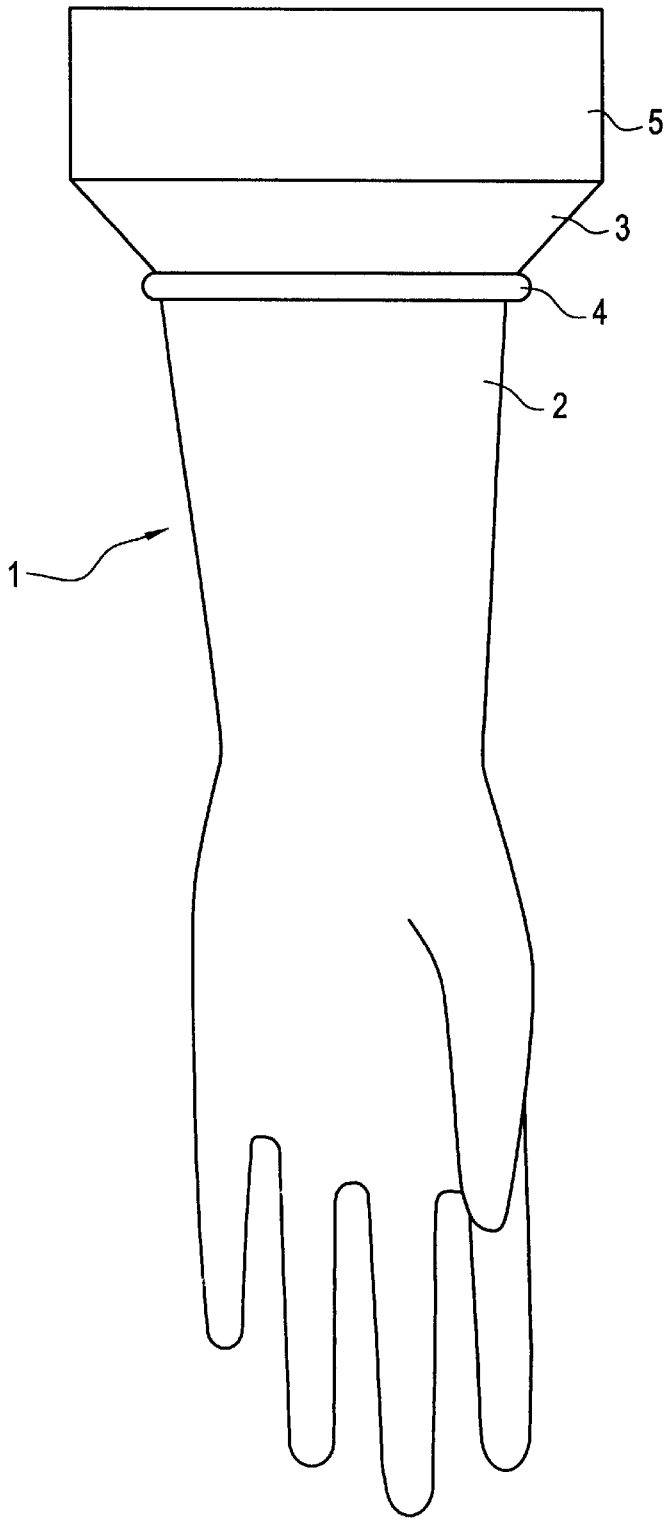
FIG. 1 shows schematically a side view of a mould for producing a glove.

FIG. 1 shows a mould 1 made of porcelain, glass, plastic material or any other suitable material. For producing a glove, this mould is dipped at least once into liquid latex or another liquid material useable for producing a glove, wherein a layer of the latex material is deposited on the outer surface of the mould 1, which layer forms the glove after drying, whereupon the glove is pulled off from the mould by turning the inside of the layer to the outside and vice versa.

The mould 1 comprises an approximately cylindrical portion 2 corresponding to the tubular sleeve portion of the glove and a conically outwardly extending portion 3 corresponding to the cuff portion of the glove. An outwardly rounded annular projection 4 is provided between the portions 2 and 3. A cylindrical end portion 5 is provided on the mould 1.

Figure 2:
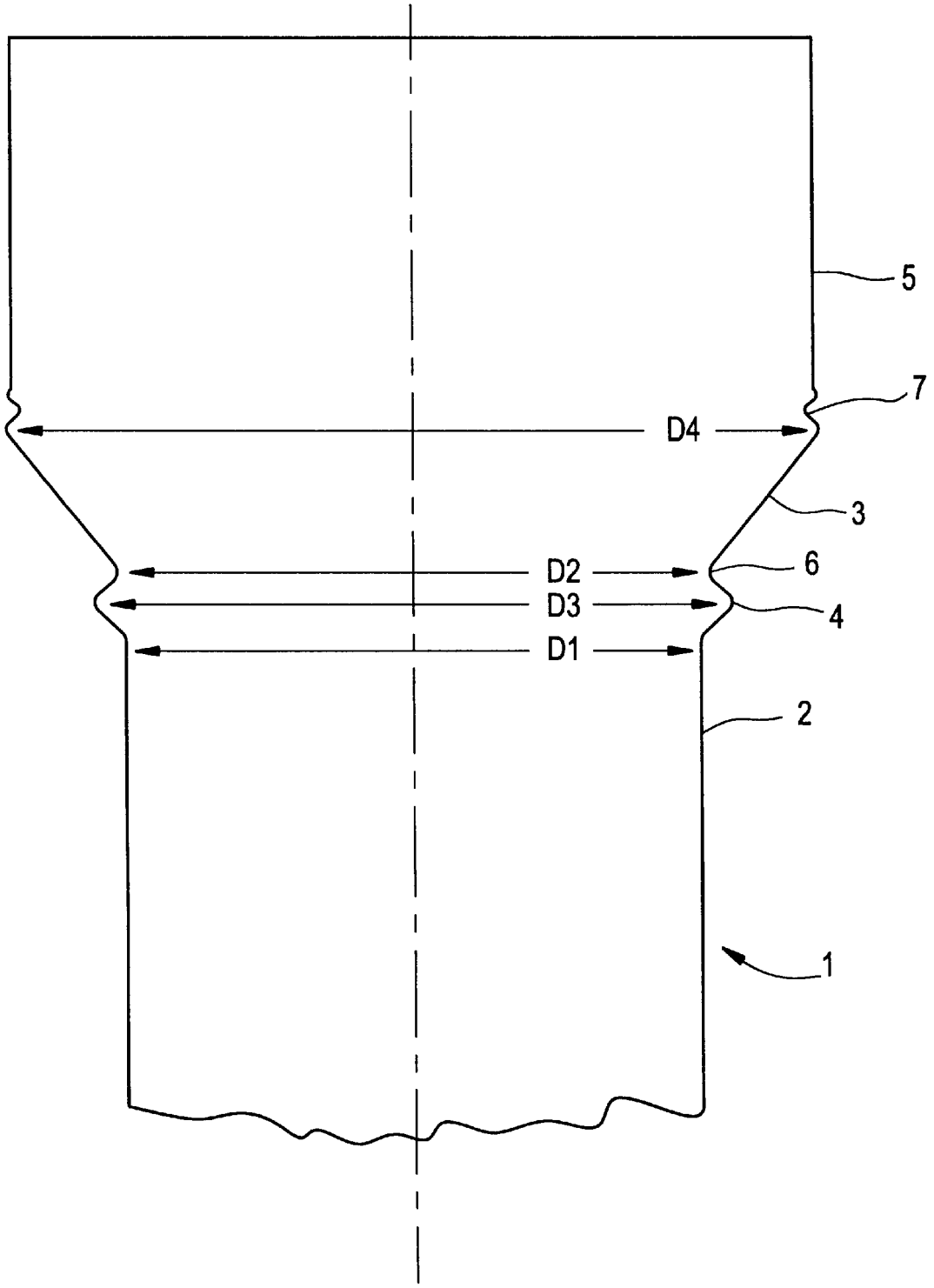
FIG. 2 shows in more detail a part of the mould in a longitudinal section.
Figure 3:
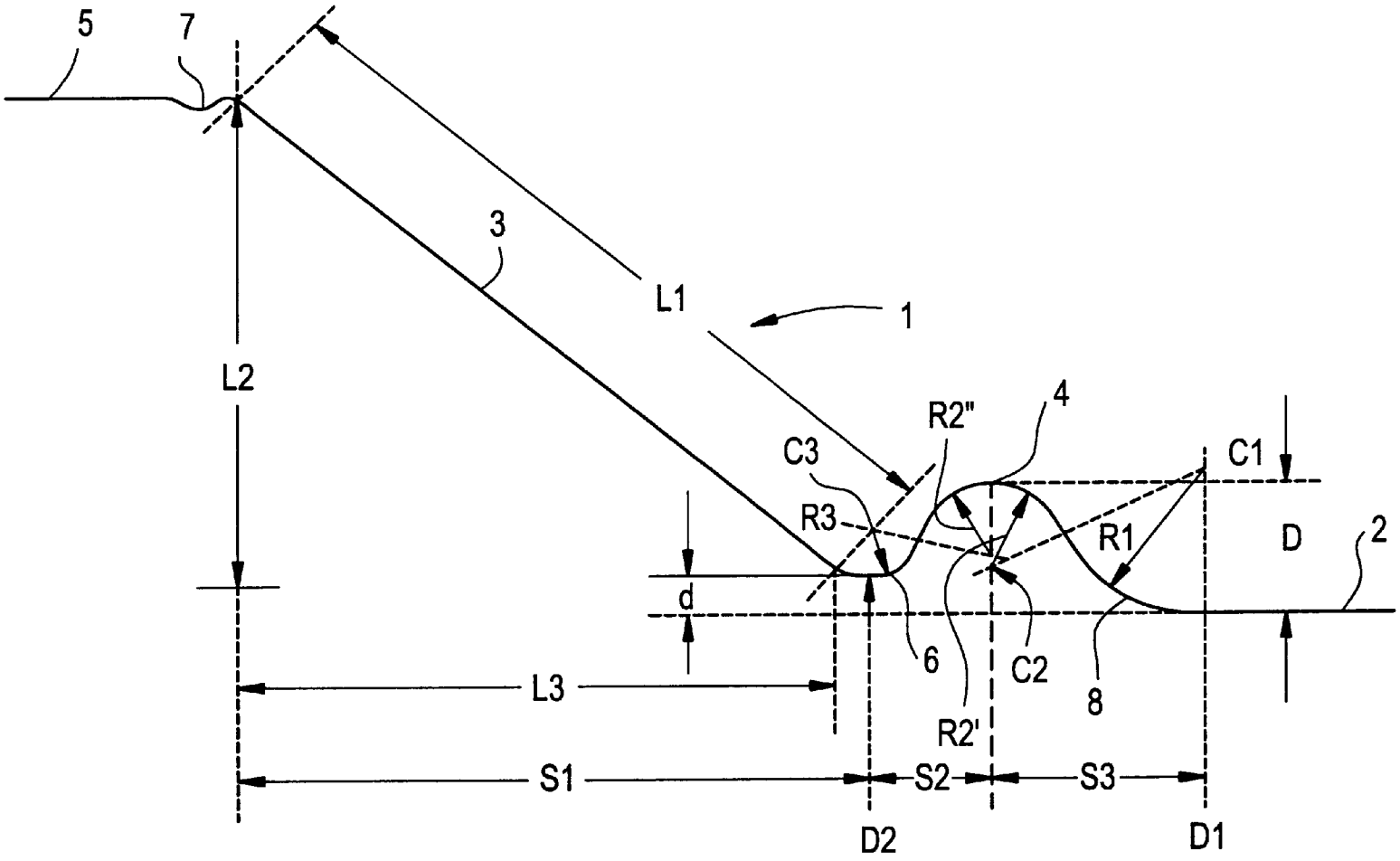
FIG. 3 shows further details of the structure of the transition between sleeve portion and cuff portion.

FIGS. 2 and 3 show details of a preferred embodiment of the mould 1. As can be seen from FIG. 2*b* the diameter D1 of the cylindrical portion 2 near the beginning of the annular projection 4 is smaller than the diameter D2 at an inwardly rounded transition portion 6 between projection 4 and conical portion 3. The difference between diameters D1 and D2 corresponds essentially to two times the wall thickness of the glove material, that means that the difference d in FIG. 3 corresponds essentially to the wall thickness of the glove material. This difference d can also be greater than the wall thickness of the glove material.

The diameter D3 of the mould 1 at the annular projection 4 is greater than diameter D2 and smaller than the diameter D4 at the outer end of the conical portion 3. A groove 7 is provided at the outer end of the conical portion 3 on the cylindrical end portion 5.

FIG. 3 shows details of the radii of the undulations on the mould 1. The transition portion 8 between cylindrical portion 2 and projection 4 is provided with a radius R1, wherein the centre C1 of this radius R1 lies essentially on the diameter D3 of the projection 4. The radius R2 of the essentially semi-circular cross section of the projection 4 is smaller than radius R1, wherein the centre C2 of this radius R2 lies approximately on diameter D2 of the inwardly rounded transition portion 6. Finally, the radius R3 of the rounded transition portion 6 is smaller than R2 and the centre C3 of this radius lies on a diameter between D2 and D3.

In a practical embodiment, the dimensions of FIG. 3 are as follows:

d is about 1.5 mm

R1 is about 5 mm

R2 is about 2.5 mm

R3 is about 1.5 mm

L1 is about 26 mm

L2 is about 17 mm

L3 is about 20 mm

S1 is about 21 mm

S2 is about 4 mm

S3 is about 7 mm

D is about 4.5 mm, wherein D is the height of the projection 4.

Preferably, the projection 4 of the mould 1 is provided with two different radii, one radius R2' of about 2.7 mm and a second radius R2" of about 2.2 mm, wherein the centre of radius R2' is on a smaller diameter than the centre of radius R2" and R2' is on the side of the cylindrical portion, whereas R2" is located on the side of the conical portion 3.

Figure 4:
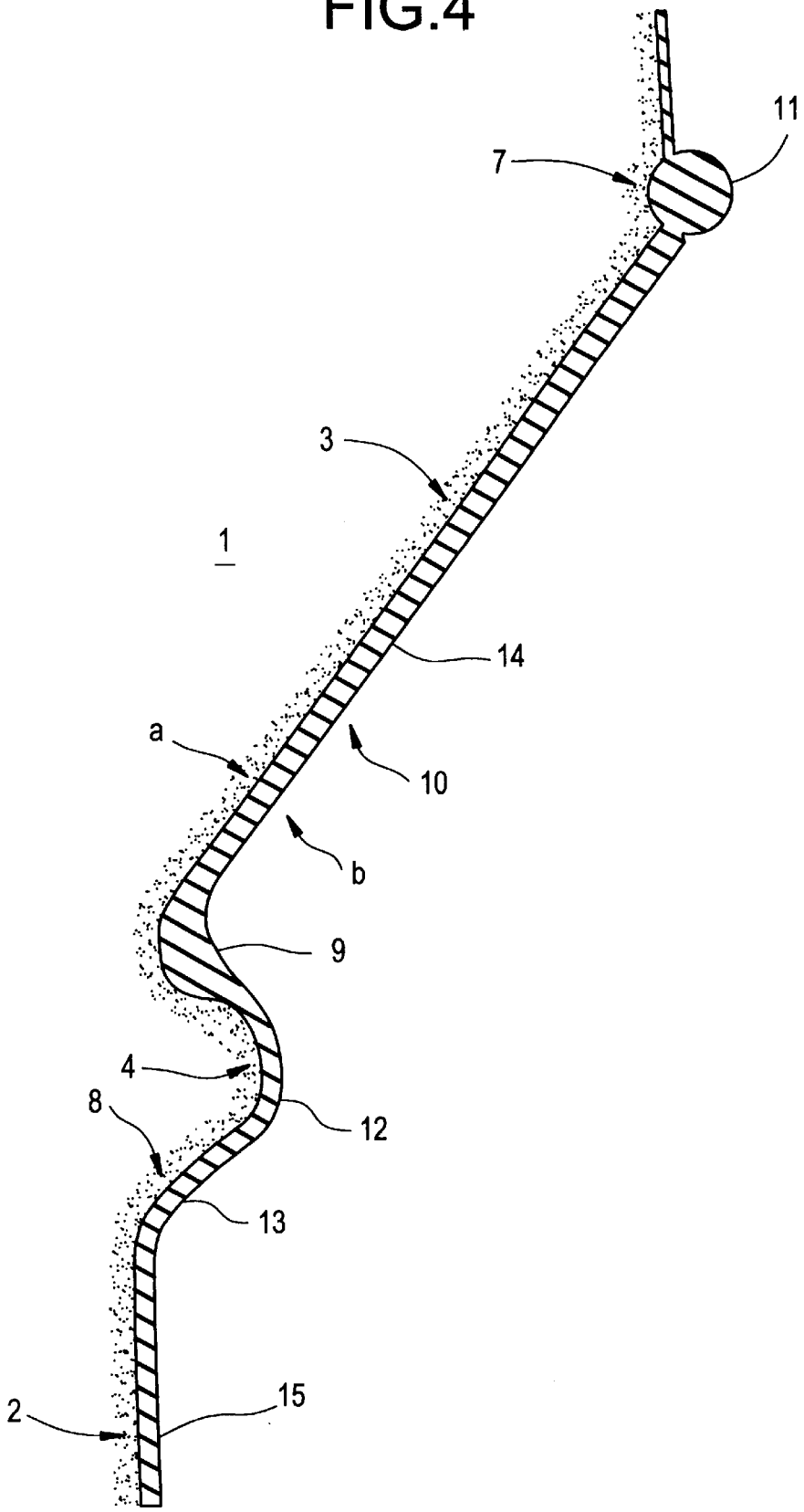
FIG. 4 shows a part of the glove in longitudinal section on the mould.

After dipping the mould 1 perpendicularly into a liquid of latex or the like, a layer 10 of latex is deposited on the outer surface of the mould 1, as shown in FIG. 4, which layer 10 is dried before pulling off from the mould 1. The layer 10 corresponds to the glove or the wall thickness of the glove, respectively. As shown in FIG. 4, more liquid material is deposited on the transition portion 6 between projection 4 and conical portion 3, due to the small radius R3 of this inwardly rounded transition portion 6 of the mould, whereas the layer 10 has an essentially uniform thickness all over the outer surface of the mould 1. In this way, the layer 10 is provided with a thickened portion 9. Furthermore, a bead 11 is formed on the groove 7, which bead 11 can also be provided by rolling up the free end portion of a layer 10 extending over the cylindrical end portion 5.

In FIG. 4, a tubular sleeve portion 15 is provided on the cylindrical portion 2 of the mould 1. 13 is an undulation of the layer 10 corresponding to the inwardly rounded transition portion 8 of the mould. 12 is an undulation of the layer 10 corresponding to the annular projection 4, and 14 is a conical portion extending outwardly in a straight line. a is the inner side of the layer 10 on the mould 1, and b the outer side.

Figure 5:
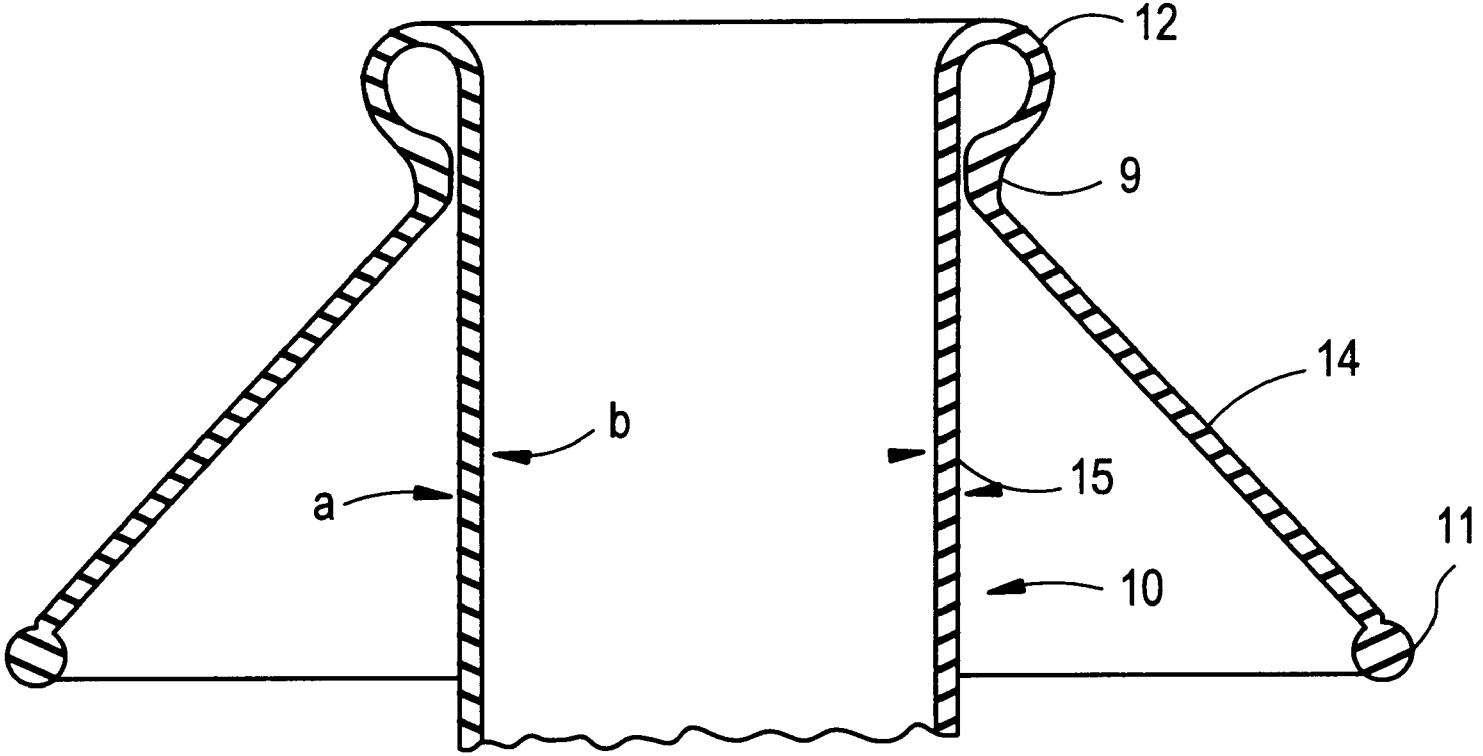
FIG. 5 shows in a longitudinal section the glove with folded-back cuff portion after removal from the mould.

The layer 10 deposited on the mould 1 corresponds to the glove 10, the end part of which is shown in FIG. 5. By pulling off the layer 10 from the mould I and turning the inside a to the outside and the outside b to the inside, the undulation 13 becomes directed outwardly and in the same way, the undulation 12 becomes directed inwardly whereas the thickened portion 9 corresponding to the inwardly rounded transition portion 6 of the mould becomes an outwardly directed undulation of the glove 10. The cuff portion 14 of the glove 10 extends conically outwardly in extension of the tubular sleeve portion 15 as also in the turned inside-out form of the layer 10, diameter D4 is larger than D2.

After folding back the cuff portion 14 around the inwardly directed undulation 12, the thickened undulated portion 9 is opposite the outer circumference of the tubular sleeve portion 15 as shown in FIG. 5, wherein the thickened ring portion 9 has essentially the same diameter as on the mould 1 in FIG. 4. In the same way, the cuff portion 14 and the bead 11 have essentially the same diameter and configuration as in FIG. 4, so there is no stress within the material of the glove 10 when the cuff portion 14 is folded back as shown in FIG. 5. Due to turning around the undulation 12 of FIG. 4 into the outwardly undulated portion 12 of FIG. 5, neither do any stresses arise in the material of the glove in this portion 12, so the shape of the glove as shown in FIG. 5 is maintained stable. The stable form of the glove as shown in FIG. 5 is assisted by the thickened undulated portion 9 which acts as a reinforcement having a stable diameter, so a shifting of this reinforced portion 9 along the longitudinal axis of the glove is hindered because shifting of the reinforced portion 9 would introduce stresses into the material of the glove 10. Furthermore, the stable form of the glove in FIG. 5 is assisted by the bead 11 on the free end of the cuff portion 14 and the straight form of the cuff portion 14.

Figure 6:
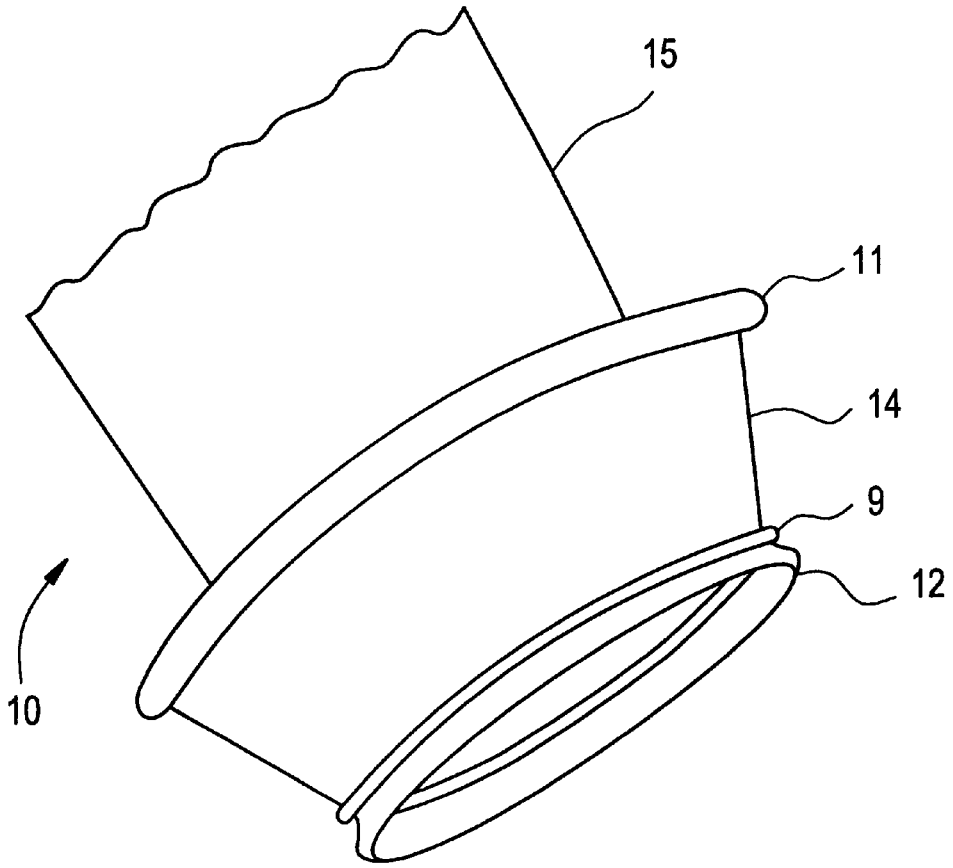
FIG. 6 is a perspective view of the cuff portion of the glove corresponding to FIG. 5.

FIG. 6 shows in a perspective view the end portion of the glove 10, wherein the cuff portion 14 is folded back as shown in FIG. 5.

Figure 7:
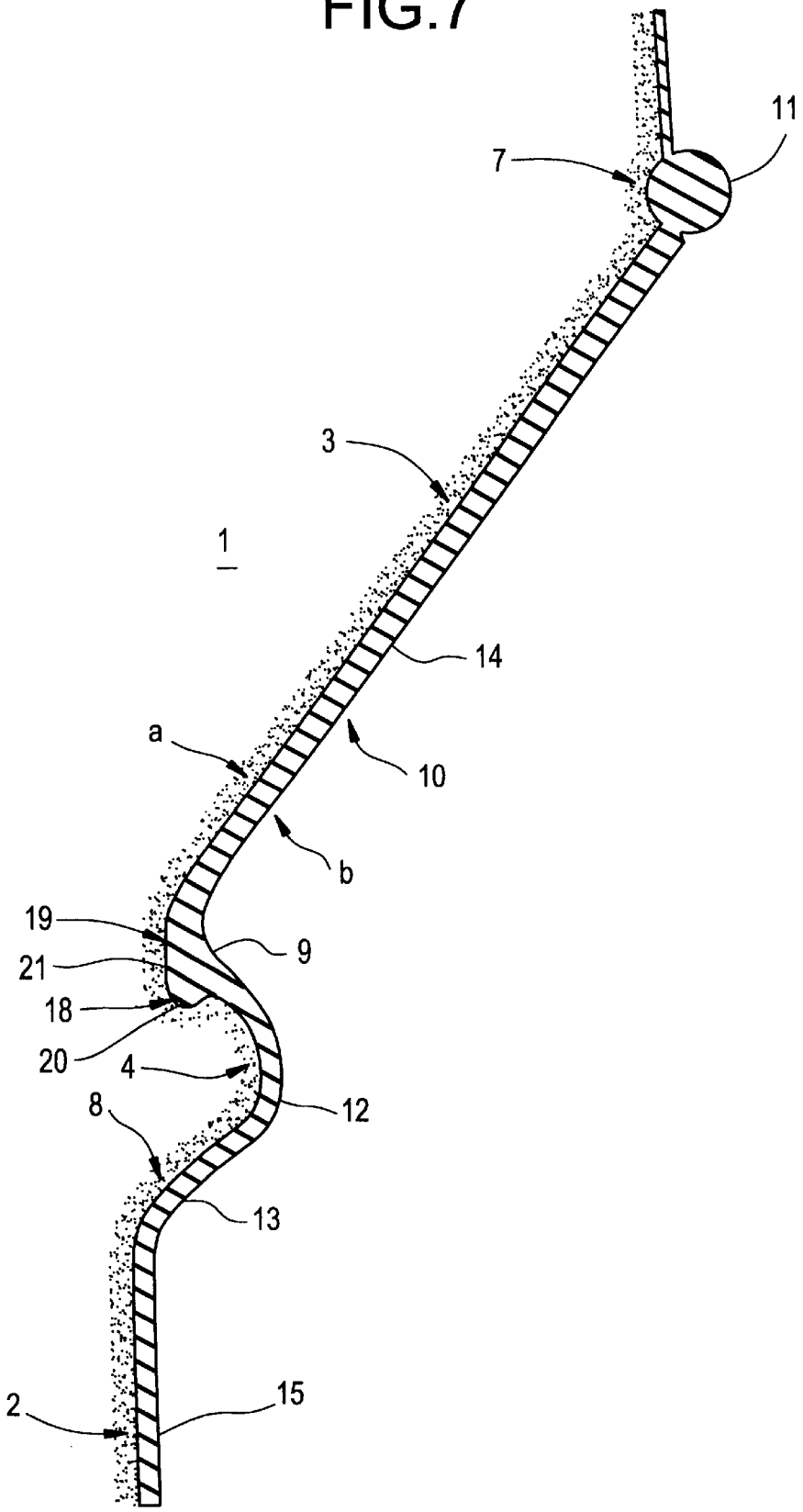
FIG. 7 shows a modified embodiment in a longitudinal section view corresponding to FIG. 4.

In the embodiment of FIG. 7, the transition portion 6 of the mould in FIG. 4 is modified. A groove 18 is provided on the projection 4, which groove 18 extends perpendicularly in dipping direction, so that a certain amount of liquid material is collected in the groove 18 when the mould is dipped perpendicularly into the liquid. Depending on the depth of the groove 18 in FIG. 7, a more thickened portion 9 can be provided.

Additionally, a small cylindrical portion 19 is provided on the mould 1, which cylindrical portion 19 connects one side of the groove 18 with the conical portion 3.

Figure 8:
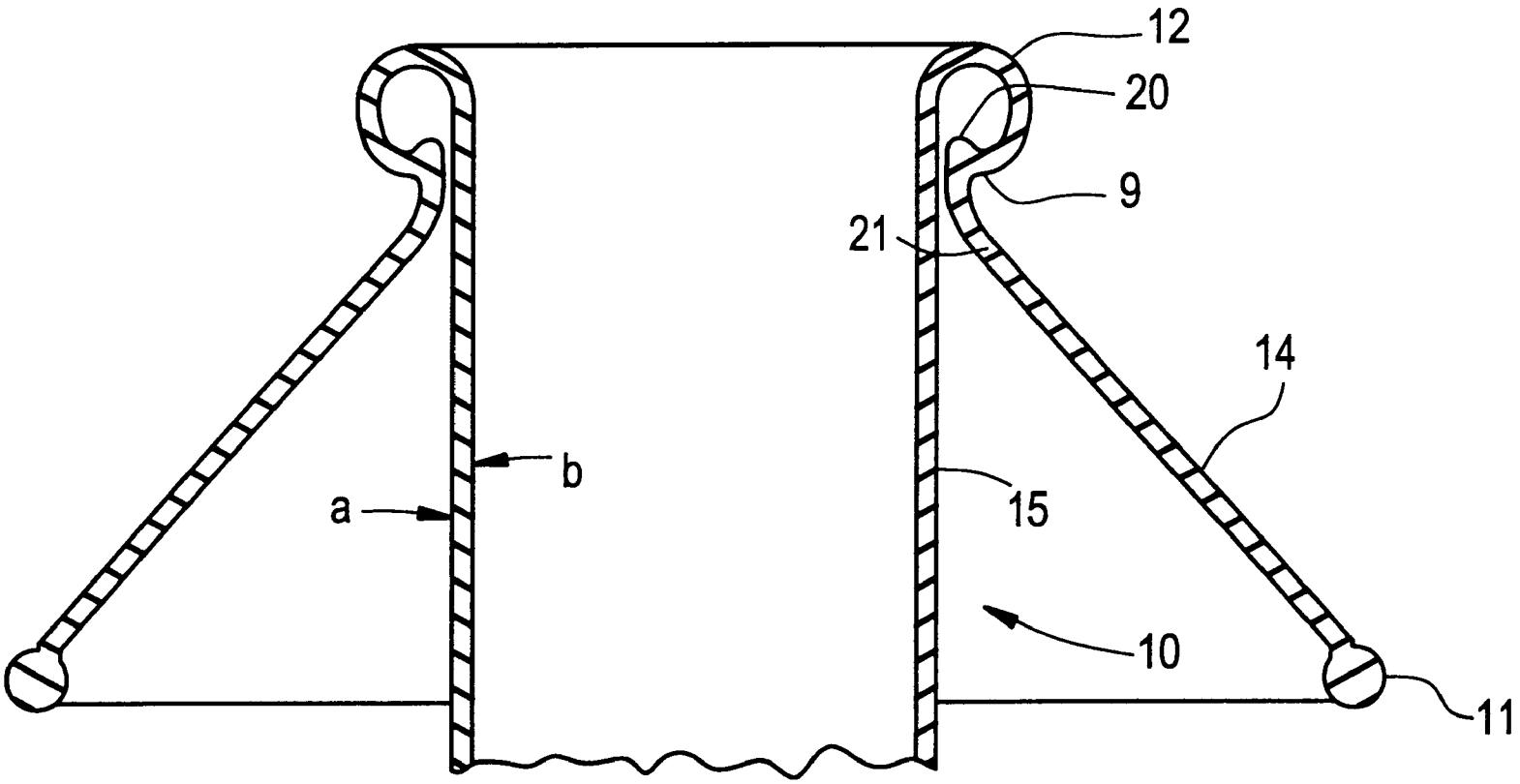
FIG. 8 shows in longitudinal section the glove with folded-back cuff portion after removal from the mould of FIG. 7.

FIG. 8 shows the glove produced on the mould 1 of FIG. 7, wherein an annular rib 20 is provided on the thickened portion 9 corresponding to the groove 18 of the mould. A cylindrical portion 21 of the glove between the rib 20 and the cuff portion 14 corresponds to the cylindrical portion 19 of the mould. By this cylindrical portion 21, a larger contact surface is provided for abutting on the outer circumference of the sleeve portion 15. The embodiment of FIG. 8 assists the stiffness of the cuff portion in the folded-back position.

Figure 9:
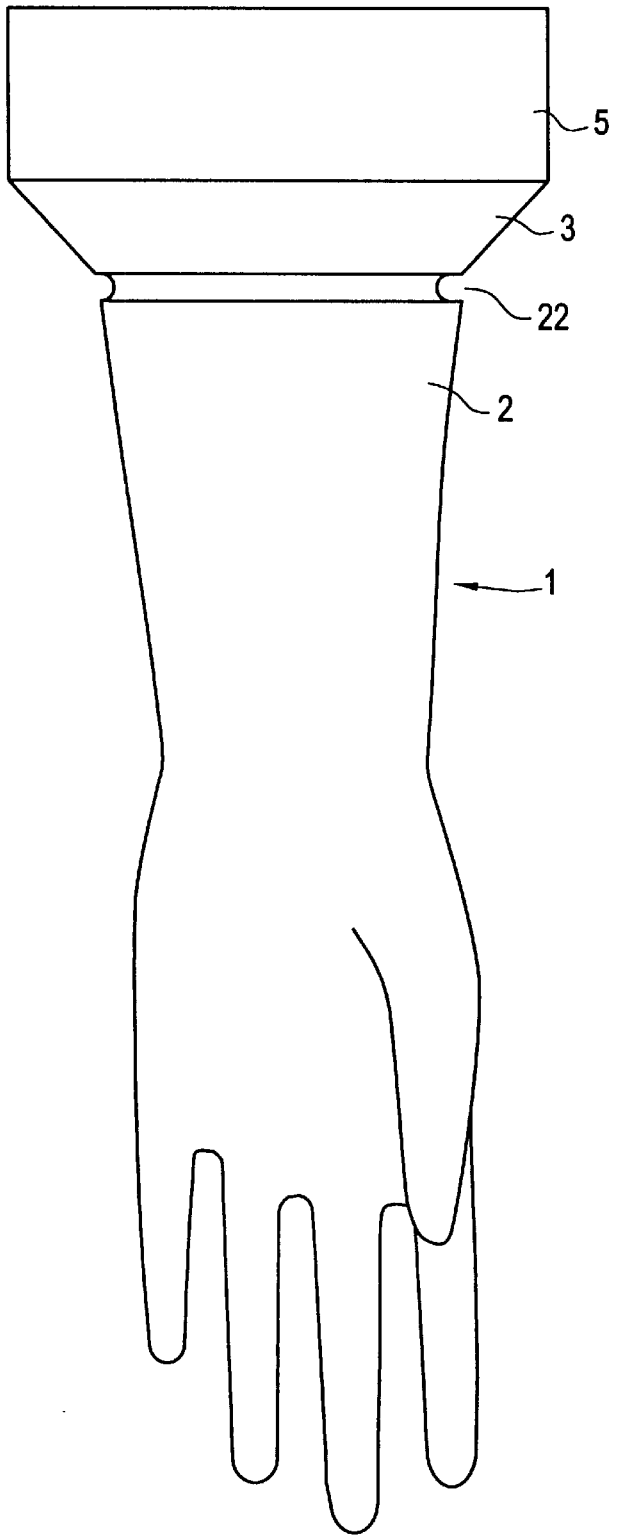
FIG. 9 shows another embodiment of the mould.
Figure 10:
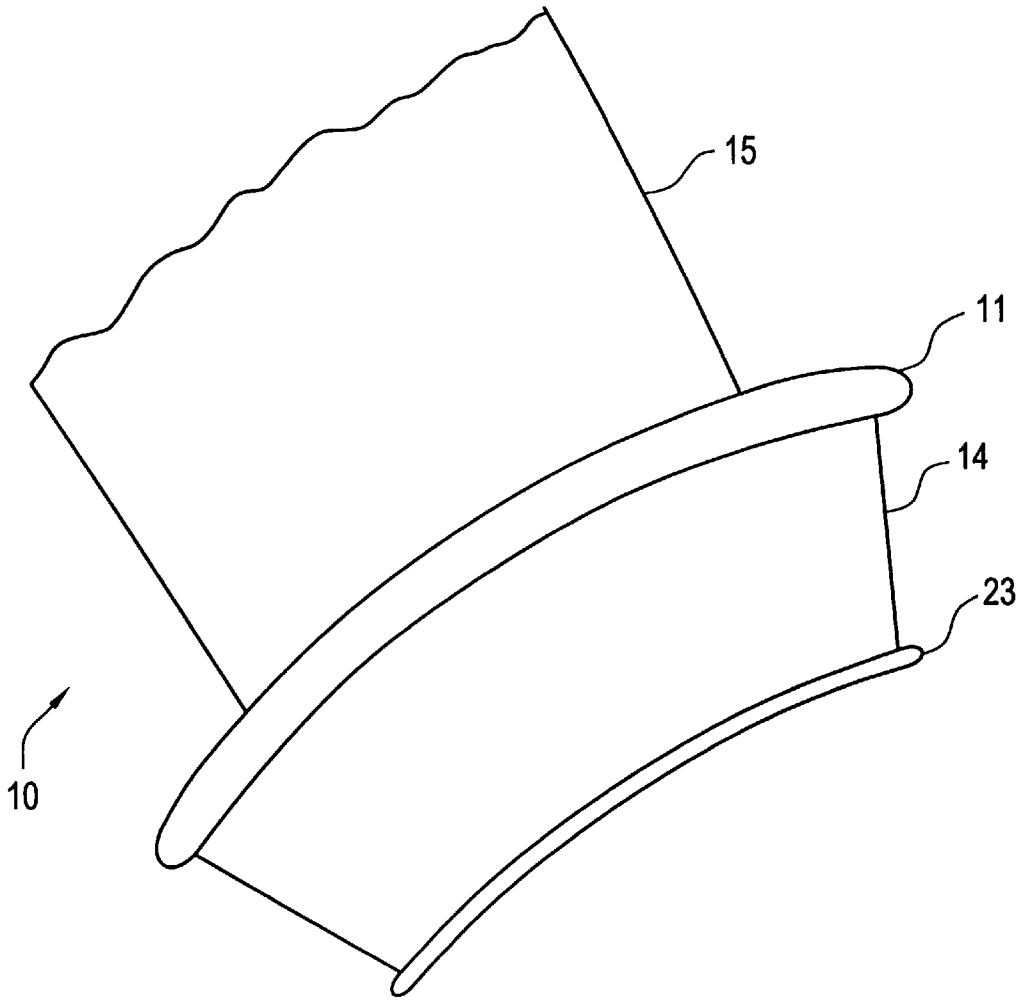
FIG. 10 is a perspective view of the cuff portion of the glove as produced on a mould according to FIG. 9.

FIG. 9 shows another embodiment of the mould 1, wherein a groove 22 is provided between cylindrical portion 2 and conical portion 3. A thicker layer is deposited in the groove 22 when the mould 1 of FIG. 9 is dipped perpendicularly into the liquid. Therefore, a thickened portion or rib 23 is provided corresponding to the groove 22, when the cuff portion 14 is folded back as shown in FIG. 10.

The groove 22 can have a width of about 2 mm to about 10 mm.

The wall thickness of the glove can be about 0.2 mm up to 3 mm of rubber or another flexible material. The angle of the mould between cylindrical portion 2 and conical portion 3 can be about 100°–170°, preferably between 120° and 150°.

Figure 11:
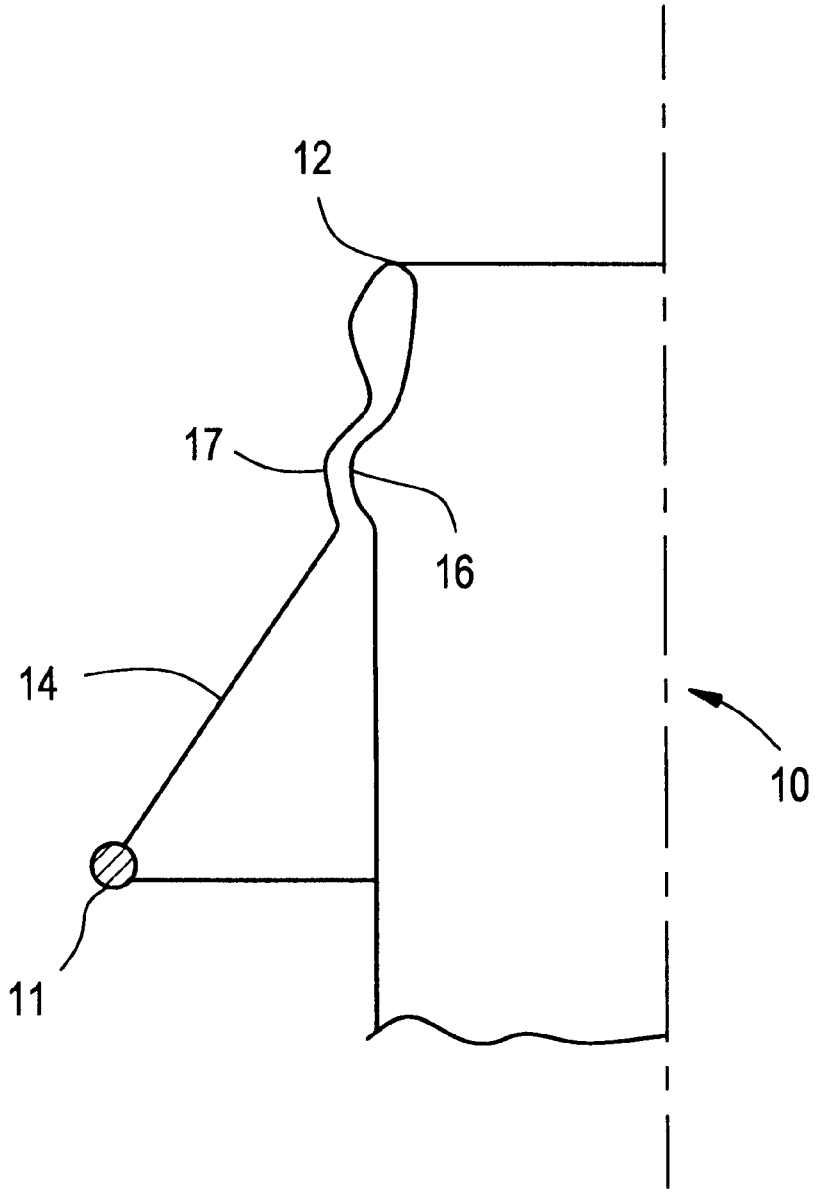
FIG. 11 shows another embodiment of a glove in a longitudinal section.

A modified embodiment of the invention is shown in FIG. 11, wherein additional undulations 16 and 17 are provided, which engage in one another when the cuff portion 14 is folded back. Such additional undulations 16 and 17 can be provided instead of a thickened portion 9. These undulations 16 and 17 extend annularly round the circumference of the glove. Correspondingly, a groove is provided on the cylindrical portion 2 of a not shown mould for forming the undulation 16, whereas an additional groove is provided between inwardly rounded transition portion 6 and conical portion 3 of the mould for forming the undulation 17.

The present invention relates not only to a glove with fingers, but also to a mitten glove or fingerless.

Furthermore, only a sleeve can be provided according to the present invention with a protecting cuff portion, which sleeve can be worn either over the bare hands or over other gloves for protection against liquid flowing back when the arms are raised. FIGS. 6 and 10 show such a sleeve 15 with cuff portion 14 and without the finger portion, which sleeve can be pulled over the hand and arm. In this case, the diameter of the sleeve portion 15 will be designed such that the sleeve portion 15 will fit tightly around the arm.

A mould for producing such a protecting sleeve can have the shape shown in FIG. 2, wherein the finger portion is omitted. After removing the layer from the mould, the closed end of the sleeve portion can be cut off to provide a protecting sleeve open at both ends.

I claim:

1. Glove of resilient material forming essentially a tubularly-shaped glove wall, said glove wall forming a sleeve portion (15) and a cuff portion (14), said cuff portion extending conically outwardly from the sleeve portion when configured in a linear position in which it forms a linear extension of the sleeve portion (15), but which can be configured in a folded-back position in which it is folded outwardly back toward the sleeve portion, in which folded-back position a free end of the conically outwardly extending cuff portion (14) is spaced a radial distance from an outer circumference of the sleeve portion (15), wherein, in a cross-sectional view, cut longitudinally of the essentially tubularly-shaped glove wall when the cuff portion is in the linear position, said glove wall forms at least one inwardly directed undulation (12) directed toward a center of the essentially tubularly-shaped glove wall, said undulation being positioned between the sleeve portion (15) and the cuff portion (14), said glove wall further including a thickened wall portion (9) adjacent the undulation (12), between the undulation and the cuff portion, the cuff portion and the thickened wall portion being folded back about the undulation (12), when the cuff portion (14) is moved between the linear position and the folded-back position.

2. A glove as in claim 1 wherein an inner diameter, on an interior surface of the essentially tubularly-shaped glove wall, of the undulation, is smaller than an adjacent inner diameter of the sleeve portion when the cuff portion is in the linear position.

3. A glove as in claim 1 wherein an outer diameter, on an exterior surface of the essentially tubularly-shaped glove wall, of the thickened wall portion (9), corresponds to an outer diameter of the sleeve portion such that the thickened wall portion abuts on an outer surface of the sleeve portion when the cuff portion is folded back into the folded-back position.

4. A glove as in claim 1 wherein the cuff portion has a free end with a thickened bead extending thereabout.

5. A method for producing the glove of claim 1, comprising the steps of:

providing a mould (1) for producing the glove and covering said mould with a fluid material which hardens to become a resilient material; and allowing said fluid material to harden to become a resilient material;

wherein said mould comprises an essentially cylindrical portion (2) for forming the sleeve portion, and a conically outwardly extending portion for forming the cuff portion, with an outer surface of the mould at an intersection of the essentially cylindrical portion and the conically outwardly extending portion having, when seen in a longitudinal sectional view, an outwardly rounded projection (4) provided annularly about a circumference of the mould (1) between the essentially cylindrical portion (2) and the conically outwardly extending portion (3).

6. A method as in claim 5 wherein said outer surface of said mould further defines an annular inwardly rounded transition trough (6) between the outwardly rounded projection and the conical outwardly extending portion (3).

7. A method as in claim 6 wherein a first diameter (D1) of the essentially cylindrical portion (2), adjacent the outwardly rounded projection (4), is smaller than a second diameter (D2) at the inwardly rounded transition trough (6) between the outwardly rounded projection (4) and the conical outwardly extending portion (3).

8. A method as in claim 7 wherein a difference (d) between the first and second diameters corresponds essentially to at least twice a wall thickness of the glove material.

9. A method as in claim 5 wherein a radius (R3) defining the transition trough (6) between the outwardly rounded projection (4) and the conical outwardly extending portion (3) is smaller than a radius (R2) defining the outwardly rounded projection (4).

10. Protective sleeve of resilient material forming essentially a tubularly-shaped protective-sleeve wall, said protective-sleeve wall forming a sleeve portion (15) and a cuff portion (14), said cuff portion extending conically outwardly from the sleeve portion when configured in a linear position in which it forms a linear extension of the sleeve portion (15), but which can be configured in a folded-back position in which it is folded outwardly back toward the sleeve portion, in which folded-back position a free end of the conically outwardly extending cuff portion (14) is spaced a radial distance from an outer circumference of the sleeve portion (15), wherein, in a cross-sectional view, cut longitudinally of the essentially tubularly-shaped protective-sleeve wall when the cuff portion is in the linear position, said protective-sleeve wall forms at least one inwardly directed undulation (12) directed toward a center of the essentially tubularly-shaped protective-sleeve wall, said undulation being positioned between the sleeve portion (15) and the cuff portion (14), said protective-sleeve wall further including a thickened wall portion (9) adjacent the undulation (12), between the undulation and the cuff portion, the cuff portion and the thickened wall portion being folded back about the undulation (12), when the cuff portion (14) is moved between the linear position and the folded-back position.

11. A protective sleeve as in claim 10 wherein an inner diameter, on an interior surface of the essentially tubularly-shaped protective-sleeve wall, of the undulation, is smaller than an adjacent inner diameter of the sleeve portion when the cuff portion is in the linear position.

12. A protective sleeve as in claim 10 wherein an outer diameter, on an exterior surface of the essentially tubularly-shaped protective-sleeve wall, of the thickened wall portion (9), corresponds to an outer diameter of the sleeve portion such that the thickened wall portion abuts on an outer surface of the sleeve portion when the cuff portion is folded back into the folded-back position.

13. A protective sleeve as in claim 10 wherein the cuff portion has a free end with a thickened bead extending thereabout.

* * * * *